US008680757B2

(12) United States Patent
Niessner et al.

(10) Patent No.: US 8,680,757 B2
(45) Date of Patent: Mar. 25, 2014

(54) SPARK PLUG AND METHOD FOR THE PRODUCTION THEREOF

(75) Inventors: Werner Niessner, Steinheim (DE); Christian Mayer, Untergruppenbach (DE); Alexander Schenk, Waiblingen (DE)

(73) Assignee: Federal-Mogul Ignition GmbH, Wiesbaden (DE)

( * ) Notice: Subject to any disclaimer, the term of this patent is extended or adjusted under 35 U.S.C. 154(b) by 0 days.

(21) Appl. No.: 13/420,287

(22) Filed: Mar. 14, 2012

(65) Prior Publication Data

US 2012/0235555 A1 Sep. 20, 2012

(30) Foreign Application Priority Data

Mar. 17, 2011 (DE) ..... 10 2011 014 257

(51) Int. Cl.
*H01T 13/20* (2006.01)

(52) U.S. Cl.
USPC ..... 313/141; 313/118; 313/143; 445/7

(58) Field of Classification Search
USPC ..... 313/118, 141–143; 445/7
See application file for complete search history.

(56) References Cited

U.S. PATENT DOCUMENTS

| | | | | |
|---|---|---|---|---|
| 5,554,908 | A | 9/1996 | Kuhnert et al. | |
| 5,977,695 | A | 11/1999 | Osamura et al. | |
| 6,046,532 | A * | 4/2000 | Matsutani et al. | 313/141 |
| 6,078,129 | A | 6/2000 | Gotou et al. | |
| 6,885,136 | B2 | 4/2005 | Orjela et al. | |
| 7,132,782 | B2 | 11/2006 | Kato et al. | |
| 2001/0015602 | A1 * | 8/2001 | Hori | 313/141 |
| 2001/0030495 | A1 * | 10/2001 | Kanao et al. | 313/141 |
| 2002/0003389 | A1 * | 1/2002 | Ishiguro | 313/141 |
| 2002/0108606 | A1 * | 8/2002 | Miwa et al. | 123/634 |
| 2004/0041506 | A1 * | 3/2004 | Teramura et al. | 313/141 |
| 2004/0129683 | A1 | 7/2004 | Torii et al. | |
| 2005/0179353 | A1 * | 8/2005 | Watanabe | 313/141 |
| 2007/0236125 | A1 * | 10/2007 | Lykowski et al. | 313/141 |
| 2009/0127996 | A1 | 5/2009 | Passman et al. | |

FOREIGN PATENT DOCUMENTS

| | | | |
|---|---|---|---|
| DE | 197 19 937 | A1 | 11/1997 |
| EP | 0 675 272 | A1 | 10/1995 |
| EP | 1 168 547 | A | 1/2002 |
| EP | 1 416 599 | A2 | 5/2004 |
| EP | 1 576 707 | B1 | 9/2005 |

* cited by examiner

*Primary Examiner* — Anh Mai
*Assistant Examiner* — Kevin Quarterman
(74) *Attorney, Agent, or Firm* — Reising Ethington P.C.

(57) ABSTRACT

A method for producing a spark plug which contains an inner conductor, an insulator surrounding the inner conductor, a spark plug body surrounding the insulator, and two electrodes forming an ignition gap. The first electrode is a center electrode connected to the inner conductor in an electrically conducting manner and the second electrode is a ground electrode connected to the spark plug body in an electrically conducting manner. An iridium component which contains more than 95 percent by weight of iridium is welded onto one of the electrodes. An iridium component that is punched out of an iridium sheet and has a thickness that is less in size than its diameter is also employed.

19 Claims, 2 Drawing Sheets

SPARK PLUG AND METHOD FOR THE PRODUCTION THEREOF

CROSS-REFERENCE TO RELATED APPLICATION

This application claims foreign priority based on German Patent Application Serial No. 10 2011 014 257.6, filed on Mar. 17, 2011, the content of which is incorporated herein by reference in its entirety.

BACKGROUND OF THE INVENTION

1. Field of the Invention

The invention relates to a method for the production of a spark plug which contains an inner conductor, an insulator surrounding the inner conductor, a spark plug body surrounding the insulator, and two electrodes forming an ignition gap, wherein the first electrode is a center electrode connected to the inner conductor in an electrically conducting manner and the second electrode is a ground electrode connected to the spark plug body in an electrically conducting manner, wherein, according to the method, an iridium component which contains more than 95 percent by weight of iridium is welded onto one of the electrodes.

Furthermore, the invention relates to a spark plug produced according to the method and to an iridium component provided for the same.

2. Description of the Prior Art

A method of the aforementioned type as well as a spark plug and an iridium component are known from EP 1 576 707 B1. The iridium component is produced in a powder metallurgical process by pulverizing the desired iridium alloy and subsequently pressing it isostatically. Thereafter, further steps for forming the iridium component are taken to give it its final shape. Thereafter, the iridium component can be welded onto one of the electrodes of the spark plug, for example, by laser welding.

An iridium alloy having a very high iridium content is described for the iridium component, said iridium alloy being formed from iridium and containing 1 to 3 percent by weight of rhodium, 0.1 to 0.5 percent by weight of tungsten and 0.05 to 0.01 percent by weight of zirconium with no more than minimum amounts of other substances.

An iridium alloy having such a high iridium content is to advantage in that the iridium component and the spark plug elements reinforced therewith are highly resistant to wear and tear. Such spark plugs have a very long service life. In addition, they require only relatively low ignition voltages.

However, a powder metallurgical production of the iridium components with subsequent reworking is highly complex and cost-intensive.

Another method for the production of an iridium component is known from DE 197 19 937 A1. Therein, the iridium component is formed by a wire section which is 0.5 mm to 2.0 mm in length. The semi-finished product used is an iridium wire which has an iridium content of 70 to 100 percent by weight and is cut to the desired length. Cutting is achieved by means of an abrasion procedure, e.g., abrading the wire with an abrasive. The wire can comprise a circular or a polygonal cross-section. The "abrasive cutting procedure" described uses diamond abrasive grains. Furthermore, the document describes that iridium components made of a wire section which is less than 0.5 mm in length are disadvantageous. Likewise, the separation of the iridium components from the wire-shaped semi-finished product by abrasion processes is highly complex and time-consuming.

EP 1 416 599 A2 discloses a rivet-shaped iridium component which is attached to the spark plug electrode by means of an additional component forming an intermediate layer. The rivet-shaped iridium component comprises a relatively large thickness of 0.7 mm, so that it projects far beyond the electrode surface next to the iridium component. As a result, a relatively large amount of material is required for the iridium component. The production of the iridium component in the rivet shape is highly complex. Together, these two factors lead to high production costs. The intermediate layer consists of an iridium alloy having a considerably lower iridium content, for example the intermediate layer contains 40 percent by weight of nickel. The intermediate layer is used to improve the capability of the iridium component to be connected to the base material of the electrode. Since, in this case, the intermediate layer must be handled and attached in addition to the production of the iridium component, this procedure is complex as well.

SUMMARY OF THE PRESENT INVENTION

Based on EP 1 576 707 B1, the object of the invention is to simplify the method of the aforementioned type and to improve the spark plug produced thereby.

This problem is solved by using an iridium component that is punched out of an iridium sheet and has a thickness that is less in size than its diameter.

Using an iridium sheet as semi-finished product and punching out the iridium component from an iridium sheet are to advantage in that the production of the iridium component is highly simplified thereby. Punching out is a process which is well-suited for the production of large numbers of iridium components such as they are required for the serial production of spark plugs. Despite the high brittleness and hardness of iridium, it is surprisingly possible to punch out iridium components from thin iridium sheets. The iridium components can be used and welded onto the spark plug electrode without further reworking. Punching out is, in particular, possible whenever the thickness of the iridium component is less in size than its diameter. The thickness of the iridium sheet or, rather, the iridium component should be no more than 0.4 mm.

Punching out an iridium component the thickness of which is less in size than a diameter is to further advantage in that the iridium component can, thereby, be easily handled despite its small size and can also be easily positioned on the electrode prior to being welded on. Due to its dimensions, such an iridium component does not remain standing on its narrow side which extends in parallel to the thickness direction; instead, it practically always automatically lays down on its bearing surface such that the thickness direction of the iridium component extends perpendicularly to the bearing surface. It is possible to prefabricate iridium components in a separate method step by punching them out, for example by a supplier, and have them delivered as bulk material. Due to their aforementioned property, the iridium components can be separated again in easy manner in an automated production process and be positioned on an electrode in a predefined orientation and be welded onto said electrode. The known iridium components that are produced from a wire-shaped semi-finished product as well as the rivet-shaped iridium components do not have such a property. The known iridium components allow separating an iridium component from a quantity delivered as bulk material and positioning said iridium component in the orientation required for being welded on with a comparatively high amount of time and effort only.

A spark plug with such an iridium component at at least one of its electrodes is to advantage in that it ensures easy ignition of the mixture even if ignition voltages are relatively low. The size of the iridium component suffices to ensure good reinforcement of the electrode and protect it from wear and tear. The spark plug has a long service life and a high life expectancy. At the same time, the iridium component is relatively small so that only a small amount of iridium, which is an expensive noble metal, is required for a spark plug.

Surprisingly, it has shown that a reasonable compromise can be reached between the contradicting requirements if the iridium component comprises a ratio of diameter to thickness which is within a range from 4 to 7. It is to particular advantage, if the ratio of diameter to thickness is within a range from 5 to 6. On the one hand, such an iridium component comprises a diameter in relation to its thickness that is large enough to easily reach the advantages described above in its handling and positioning during production. On the other hand, the iridium component simultaneously comprises a sufficiently large thickness in relation to its diameter, so that it projects beyond the electrode surface next to the iridium component in a steplike manner and protects the electrode from wear and tear. In order to keep the material requirements low, it is to advantage if the iridium component comprises a thickness within a range from 0.2 mm to 0.4 mm, more preferably within a range from 0.23 mm to 0.27 mm. Based on the ratio of diameter to thickness provided according to the invention, this results in a preferred diameter within a range from 1.0 mm to 3.0 mm, more preferably within a range from 1.2 mm to 1.5 mm.

During production, the prefabricated iridium component can be positioned on one of the electrodes and can then be connected to the electrode by means of resistance welding. To finally fix the iridium component on the electrode, laser or electron beam welding is preferably provided. Therein, the iridium component is, in particular, welded to the electrode along its complete circumference.

Since the iridium component is suitable for separate prefabrication by a supplier as described above, the iridium component according to the invention is to be placed under separate protection. The iridium component according to the invention is particularly well-suited for being welded onto the ground electrode. The spark plug, therefore, comprises an iridium component according to the invention at least at the ground electrode. Preferably, the ground electrode is bent after the iridium component has been welded on such that the iridium component forms an ignition gap with the center electrode. Therein, it can be provided that the center electrode is provided with a conventional noble metal component, for example, made of a platinum and/or iridium alloy. However, it can also be to advantage to weld an iridium component according to the invention to the center electrode as well.

The material of the iridium component contains more than 95 percent by weight of iridium. Preferably, its material contains 2 to 3 percent by weight of rhodium. Another advantageous component of the alloy is zirconium. Preferably, the content of zirconium is approximately 50 to 200 ppm, more preferably 90 to 110 ppm. A particularly advantageous alloy is one that consists of technically pure iridium with 2.5 percent by weight of rhodium and 50 to 200 ppm zirconium, more preferably approximately 100 ppm zirconium. Such an alloy comprises a high oxidation resistance, wherein the rhodium forms a protecting oxide layer which, however, does not interfere with the ignition performance.

Further advantages and features of the invention result from the subordinate claims and the following description of a few exemplary embodiments in conjunction with the drawings.

DETAILED DESCRIPTION OF THE INVENTION

Figure 1:
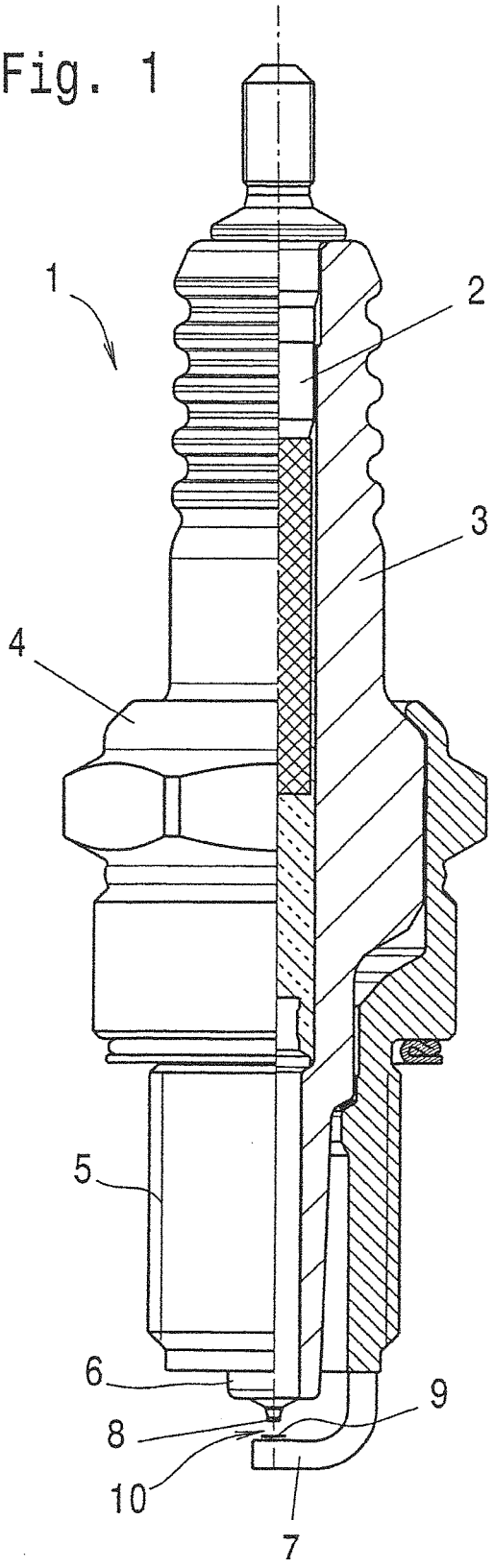
FIG. 1 is an enlarged and partially sectional view of a spark plug according to the invention.

The spark plug 1 shown in FIG. 1 contains an inner conductor 2 which is surrounded by an insulator 3. A spark plug body 4 is provided, which surrounds and receives the insulator 3. The spark plug body 4 is provided with a thread 5 on its outer surface. The spark plug 1 contains two electrodes 6 and 7. The first electrode 6 is a center electrode which is connected to the inner conductor 2 in an electrically conducting manner. The second electrode 7 is a ground electrode which is connected to the spark plug body 4 in an electrically conducting manner. A noble metal component 8 which can consist of a conventional platinum and/or iridium alloy is attached to the center electrode 6. However, the noble metal component 8 can also be an iridium component according to the present invention.

The ground electrode 7 is arranged above the center electrode 6 in the manner of a top electrode. An iridium component 9 which was punched out beforehand is welded onto the ground electrode 7. The ground electrode 7 and the iridium component 9 are arranged such that the noble metal component 8 and the iridium component 9 are facing each other and form an ignition gap 10.

The spark plug 1 can be inserted into an internal combustion engine with its thread 5 in a manner that is known as such. Therein, the area of the spark plug 1 with the electrodes 6 and 7 projects into a combustion chamber of the internal combustion engine and can ignite a fuel-air mixture there.

During the production of the spark plug 1, the iridium component 9 is fitted to the ground electrode 7. The ground electrode 7 has already been attached to the spark plug body 4, however, does not comprise its shape shown in FIG. 1 yet. The ground electrode 7 can extend in parallel to the central longitudinal axis of the spark plug 1. The iridium component 9 that has been prefabricated by punching out is positioned on the ground electrode 7 and is then connected to the ground electrode 7 by resistance welding. Subsequently, the iridium component 9 is fixed to the ground electrode 7 along its complete circumference by laser welding. While laser welding is in progress, an alloy zone which permanently fixes the iridium component 9 on the ground electrode 7 forms between the iridium component 9 and the ground electrode 7 that, preferably, consists of a highly heat-resistant nickel-base alloy. Subsequently, the ground electrode 7 is bent into its shape shown in FIG. 1 and is oriented so that the iridium component 9 forms the ignition gap 10 with the center electrode 6 or the noble metal component 8 with a defined spacing between the components 8 and 9.

Figure 2:
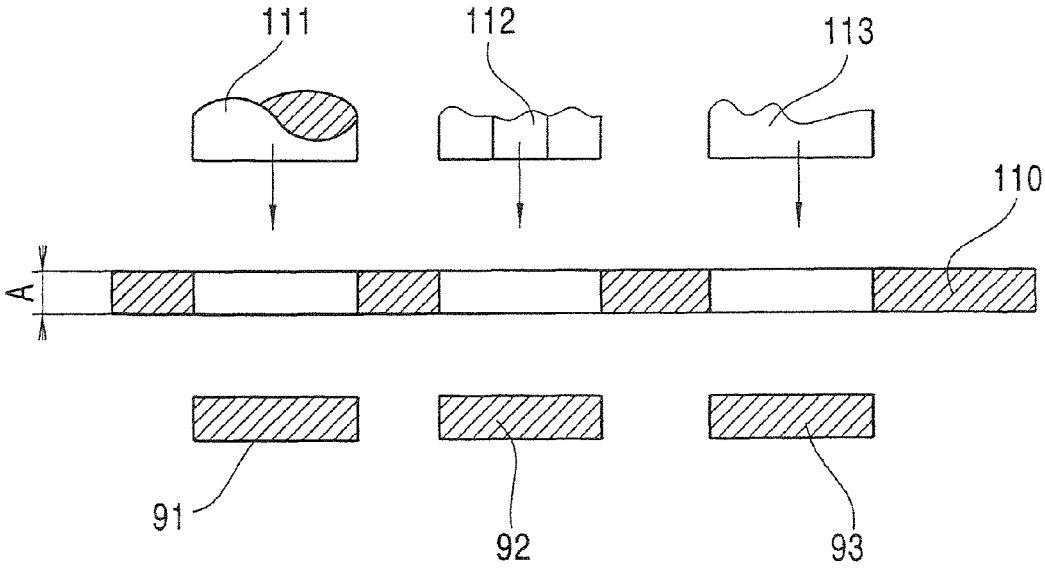
FIG. 2 is a strongly enlarged schematic view of the punching out of iridium components according to the invention.
Figure 3:
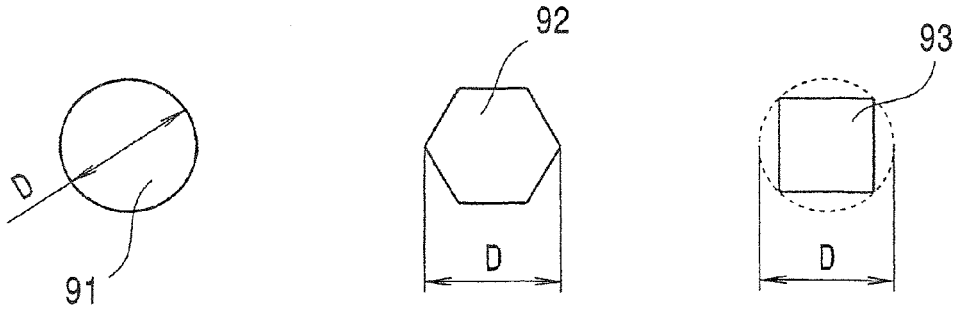
FIG. 3 is a top view of three iridium components according to the invention shown in FIG. 2 with different outer contours.

Punching out of the iridium component 9 is described by means of FIGS. 2 and 3 wherein, there, three different embodiments of the iridium component 9 are shown by way of example. The three embodiments of the iridium component 9 are designated with reference symbols 91, 92 and 93.

FIG. 2 shows an iridium sheet 110 in a sectional view perpendicular to the sheet surface. The iridium sheet 110 comprises a thickness A of 0.25 mm. An iridium component 91 is punched out of the iridium sheet 110 by means of a tool 111 that is indicated schematically. The iridium component 91, therefore, comprises the same thickness A as the iridium sheet 110. As shown in the top view, the iridium component 91 has a circular outer contour (cf. FIG. 3) with a diameter D. The diameter D exceeds the thickness A in size.

Two further iridium components 92 and 93 which comprise an outer contour that deviates from the circular shape are shown next to the iridium component 91. An outer contour of the iridium component 9 that deviates from the circular shape can improve the ignition effect of the spark plug 1. The iridium component 92 comprises a hexagonal outer contour and the iridium component 93 comprises a square outer contour. If the iridium components 92, 93 do not have a circular shape, the diameter D is to be understood as the diameter of the circle enclosing the outer contour (see FIG. 3). The tools 112, 113 for punching out the iridium components 92 and/or 93 comprise a shape that is chosen according to the outer contour of the iridium components.

The diameter D is between 1.2 mm and 1.5 mm, so that the iridium component 9 comprises a ratio of diameter D to thickness A between 5 and 6. This ratio of diameter D to thickness A is to advantage in that the iridium components 91, 92, 93 always automatically lay down again and again on a bearing surface such that their thickness direction is oriented perpendicularly to the bearing surface, even if they are handled as bulk material. The iridium components 91, 92, 93 do not remain standing on one of their narrow sides. As a consequence, their position is always defined and corresponds to the one in which they are welded onto the ground electrode 7. Welding-on is achieved such that, with its thickness A, the iridium component projects beyond the electrode surface next to the iridium component 9 in a steplike manner (cf. FIG. 1). Due to the special ratio of diameter D to thickness A, the thickness A is, on the one hand, sufficiently large to ensure that the steplike projection projects next to the iridium component high enough above the electrode surface to reach a sufficient reduction of the ignition voltage and to ensure a sufficient protection of the ground electrode 7 against wear and tear. On the other hand, the iridium component 9 is small enough to require only a small amount of noble metal per spark plug.

An iridium component 9 that is similar to the exemplary embodiments 91, 92, 93 can also be used as a noble metal component 8 on the center electrode 6. The above statements are applicable in analogy.

It is to be noted that the invention is explained above with the help of an exemplary embodiment which is presented for the purpose of illustration and description in order to explain the various principles of the invention and their practical application. This is not intended to exhaust or limit the invention to a precise form that is disclosed and obviously many modifications and variations are possible in the light of the above teachings.

We claim:

1. A method for producing a spark plug comprising an inner conductor, an insulator surrounding the inner conductor, a spark plug body surrounding the insulator, and two electrodes forming an ignition gap, wherein the first electrode is a center electrode connected to the inner conductor in an electrically conducting manner and the second electrode is a ground electrode connected to the spark plug body in an electrically conducting manner, wherein, said method comprises the steps of welding an iridium component comprising more than 95 percent by weight of iridium onto one of the electrodes, and punching said iridium component out of an iridium sheet, wherein said iridium component is punched out of said iridium sheet with a ratio of diameter to thickness in a range from 4 to 7 that facilitates easy handling of said iridium component during production and reduces wear and tear of said one of the electrodes during operation.

2. The method according to claim 1, further comprising the step of prefabricating the iridium component by punching out in a separate method step.

3. The method according to claim 1, further comprising the step of positioning the punched-out iridium component on the electrode and then connecting the punched-out iridium component to the electrode by resistance welding.

4. The method according to claim 1, further comprising the step of fixing the iridium component to the electrode by laser or electron beam welding.

5. The method according to claim 1, further comprising the step of welding the iridium component onto the ground electrode.

6. The method according to claim 5, further comprising the step of bending the ground electrode after the iridium component has been welded on such that the iridium component forms an ignition gap with the center electrode.

7. An iridium component which consists of more than 95 percent by weight of iridium, for being welded onto at least one electrode of a spark plug which contains an inner conductor, an insulator surrounding the inner conductor, a spark plug body surrounding the insulator, and two electrodes forming an ignition gap, wherein the first electrode is a center electrode connected to the inner conductor in an electrically conducting manner and the second electrode is a ground electrode connected to the spark plug body in an electrically conducting manner, wherein the iridium component is punched out of an iridium sheet with a ratio of diameter to thickness in a range from 4 to 7 that facilitates easy handling of the iridium component during production and reduces wear and tear of said one of the electrodes during operation.

8. The method according to claim 1, wherein the iridium component comprises a ratio of diameter to thickness in a range from 5 to 6.

9. The iridium component according to claim 7, having a thickness of no more than 0.4 mm.

10. The iridium component according to claim 7, having a diameter within a range from 1.0 mm to 3.0 mm.

11. The iridium component according to claim 7, wherein the iridium alloy contains a content of rhodium of 2 to 3 percent by weight.

12. The iridium component according to claim 7, wherein the iridium alloy contains a content of zirconium of 50 to 200 ppm.

13. The iridium component according to claim 7, in which the ratio of diameter to thickness is within a range from 5 to 6.

14. The iridium component according to claim 9 having a thickness of 0.2 mm to 0.4 mm.

15. The iridium component according to claim 10 having a diameter within a range from 1.2 mm to 1.5 mm.

16. The iridium component according to claim 11, wherein the iridium alloy contains a content of rhodium of 2.5 percent by weight.

17. The iridium component according to claim 12, wherein the iridium alloy contains a content of zirconium of 90 to 110 ppm.

18. A spark plug which contains an inner conductor, an insulator surrounding the inner conductor, a spark plug body surrounding the insulator, and two electrodes forming an ignition gap, wherein the first electrode is a center electrode connected to the inner conductor in an electrically conducting manner and the second electrode is a ground electrode connected to the spark plug body in an electrically conducting manner, and wherein an iridium component is adjacent to the ignition gap, and is arranged at least at one of the electrodes, wherein said iridium component consists of more than 95 percent by weight of iridium, for being welded onto at least one electrode of a spark plug which contains an inner conductor, an insulator surrounding the inner conductor, a spark plug body surrounding the insulator, and two electrodes forming an ignition gap, wherein the first electrode is a center electrode connected to the inner conductor in an electrically conducting manner and the second electrode is a ground electrode connected to the spark plug body in an electrically conducting manner, wherein the iridium component is punched out of an iridium sheet with a ratio of diameter to thickness in a range from 4 to 7 that facilitates easy handling of said iridium component during production and reduces wear and tear of said one of the electrodes during operation.

19. The spark plug according to claim 18, wherein the iridium component is arranged at least at the ground electrode.

* * * * *